US005123162A

United States Patent [19]

Wing et al.

[11] Patent Number: 5,123,162

[45] Date of Patent: Jun. 23, 1992

[54] AUTOMATIC RIVET FEED APPARATUS

[75] Inventors: Harold R. Wing, Springville; David Francis, Orem, both of Utah

[73] Assignee: Wing Enterprises, Inc., Springville, Utah

[21] Appl. No.: 623,189

[22] Filed: Dec. 6, 1990

[51] Int. Cl.[5] ..... B23Q 7/10

[52] U.S. Cl. ..... 29/818; 29/809

[58] Field of Search ..... 29/809, 810, 818; 72/391.6, 453.19

[56] References Cited

U.S. PATENT DOCUMENTS

| | | | |
|---|---|---|---|
| 2,495,070 | 1/1950 | Mellodge | 72/391.6 X |
| 3,910,324 | 10/1975 | Nasiatka | 29/809 X |
| 4,005,519 | 2/1977 | Di Maio et al. | 29/818 |
| 4,044,462 | 8/1977 | Anselmo | 29/809 |
| 4,747,294 | 5/1988 | Schwartz et al. | 29/809 X |
| 4,754,643 | 7/1988 | Weeks, Jr. et al. | 29/809 X |

FOREIGN PATENT DOCUMENTS

| | | | |
|---|---|---|---|
| 0216947 | 10/1985 | Japan | 29/818 |

*Primary Examiner*—Timothy V. Eley
*Assistant Examiner*—C. Richard Martin
*Attorney, Agent, or Firm*—Thorpe, North & Western

[57] ABSTRACT

An automatic rivet feed apparatus which can be used as a retrofit to an existing power driven riveting tool or incorporated integrally into a riveting tool. A rivet strip holds each of the plurality of rivets at individual fixed positions on the rivet strip. Included is a rivet strip release hook which stops the rivets, as they are advanced one-by-one, at rivet pick-up point and releases each of the rivets from the rivet strip. A hand mounted on the end of a pneumatic ram grips the rivets at the rivet pick-up point. The pneumatic ram moves the rivet forward and rotates to place the rivet in alignment with the nose piece of the riveting tool. The pneumatic ram then retracts and inserts the mandrel of the rivet into the nose piece and returns to the rivet pick-up point to repeat the steps.

15 Claims, 13 Drawing Sheets

AUTOMATIC RIVET FEED APPARATUS

BACKGROUND

1. The Field of the Invention

This invention relates to apparatus used to fasten materials together using rivets. More particularly, the present invention is related to apparatus used to install blind rivets.

2. The Prior Art

In instances where two layers of material must be securely joined together, rivets often perform better than screws, bolts, and other types of fasteners. Rivets have found numerous uses in modern fabrication technology.

In particular, "blind rivets," or rivets which can be installed by one worker from one side of the work, are widely used. Blind rivets generally comprise a rivet with a bore therethrough and having a head, a shank, and a tail positioned on the shank opposite to the head. The head is formed so that it will grip the surface of the material being fastened. A mandrel is provided through the bore in the rivet.

In use, the tail of the blind rivet is inserted into a pre-drilled hole provided in the material. The rivet is set in the work piece by drawing the mandrel through the bore in the rivet. As the mandrel is drawn through the bore, the shank of the rivet expands and clamps the parts together. In some types of blind rivets the mandrel is then discarded, in other types, the mandrel is kept and reused.

Blind rivets have become so ubiquitous in the fabrication arts that numerous tools are now available to assist with installing blind rivets. Hand operated tools are useful in small scale work but power driven riveting tools are now the norm in industrial and commercial settings. Such power driven riveting tools can be powered from pneumatic, electric, or hydraulic sources.

While blind rivets generally perform well and are easy to install, efforts have been made to streamline the installation process. Most power driven riveting tools require that the operator insert a new rivet into the nose piece of the riveting tool each time a rivet is set. The manual loading of individual rivets takes a considerable amount of an operator's time.

In order to improve the efficiency of riveting operations, various apparatus have been proposed to automate the loading of rivets into the nose piece of riveting tools. One such apparatus requires the operator to insert the nose piece riveting tool into the rivet loading apparatus. Disadvantageously, the time required to move the riveting tool away from the work piece and to the loading apparatus can equal or exceed the time required to manually load a rivet.

In order to allow an operator to keep the riveting tool at the work piece while a new rivet is being loaded, other rivet feed apparatus have been made available. Some of these apparatus utilize a large floor mounted console (e.g., twenty-five pounds) which contains a large supply of rivets. Pneumatic power forces the new rivets through a tube to the nose piece of a pistol unit where the rivets are one-by-one loaded for use. Such large units lack portability, are expensive to acquire and maintain, and often require the purchase of rivets and supplies from a single source.

These and other drawbacks are inherent in the rivet feeding apparatus available in the art. In view of the drawbacks found in the present state of the art, it would be an advance in the art to satisfy the long felt need to provide an automatic rivet feed apparatus without these drawbacks.

BRIEF SUMMARY AND OBJECTS OF THE INVENTION

In view of the above described state of the art, the present invention seeks to realize the following objects and advantages.

It is an object of the present invention to provide an automatic rivet feed apparatus which operates more efficiently than available devices.

It is also an object of the present invention to provide an automatic rivet feed apparatus which may be retrofitted onto a variety of existing riveting tools.

It is another object of the present invention to provide an automatic rivet feed apparatus which can be adapted to accept a variety of types and sizes of rivets.

It is yet another object of the present invention to provide an automatic rivet feed apparatus which can be implemented at a lower cost than previously available devices.

It is still another object of the present invention to provide an automatic rivet feed apparatus which is compact and lightweight.

It is another object of the present invention to provide an automatic rivet feed apparatus which increases the overall speed of a riveting operation.

These and other objects and advantages of the invention will become more fully apparent from the description and claims which follow, or may be learned by the practice of the invention.

The present invention provides an efficient, reliable, and economical automatic rivet feed apparatus. In contrast to other automatic rivet feed devices, the embodiments of the present invention can be readily retrofitted to a number of riveting tools or integrally incorporated as part of a riveting tool. The structure of the present invention provides its advantages over other available devices.

The present invention comprises an apparatus for feeding rivets to the nose piece of a riveting tool including means for sequentially advancing a plurality of rivets to a rivet pick-up point. The rivet pick-up point is adjacent to, but offset from, the nose piece of the riveting tool. In the presently preferred embodiment of the present invention, a plurality of pneumatic rams sequentially advance rivets held on a carrier of some type to the rivet pick-up point.

One preferred rivet carrier is a rivet strip comprising a substrate, most preferably a flexible plastic, having a first elongated longitudinal dimension and a second lateral dimension. Included on the substrate is a means for releasibly holding each of the plurality of rivets at individual fixed longitudinal positions and means for releasibly holding each of the plurality of rivets at individual fixed lateral positions on the substrate. Using this structure, the rivets are held in a spaced relationship ready for presentation at the rivet pick-up point. Upon reaching the pick-up point, the rivets are released.

At the pick-up point, the mandrel of the rivet is moved into alignment with, and then inserted into, the nose piece of the riveting tool. Included in the present invention, is means for moving the rivet from the rivet pick-up point to a nose piece alignment point. In the presently preferred embodiment of the invention, a pneumatic ram capable of both linear extension and retraction, as well as clockwise and counter clockwise rotation, is used to place the mandrel of the rivet is alignment with the nose piece and for insertion of the rivet into the nose piece.

The preferred pneumatic ram comprises cylinder means into which a piston means is slidable disposed. Also included are means for introducing a gas into the cylinder means and means for rotating the piston means as the piston is extended out of, and retracted into, the cylinder means. It is also preferred that the means for rotating the piston comprises a guide post, with the piston fitting slidable over the guide post. A track is formed on the surface of the guide post, at least a portion of which is oriented in a direction which is non-parallel to the length of the guide post. A guide pin formed on the piston engages the track and as the piston extends out of, and retracts into, the cylinder the guide pin follows the path of the track causing the piston to rotate.

In order to carry out the function of moving the rivets from the rivet pick-up point to the nose piece, the presently preferred embodiment also includes an arm mounted on the pneumatic ram and a spring loaded hand to grip the shank of the rivets as they are presented at the rivet pick-up point. The present invention also comprises means for actuating the means for moving and the means for advancing. A means for means for mounting the other structures on the riveting tool can preferably be provided.

BRIEF DESCRIPTION OF THE DRAWINGS

In order that the manner in which the above-recited and other advantages and objects of the invention are obtained can be appreciated, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to the drawings wherein like structures will be provided with like reference designations.

Figure 1:
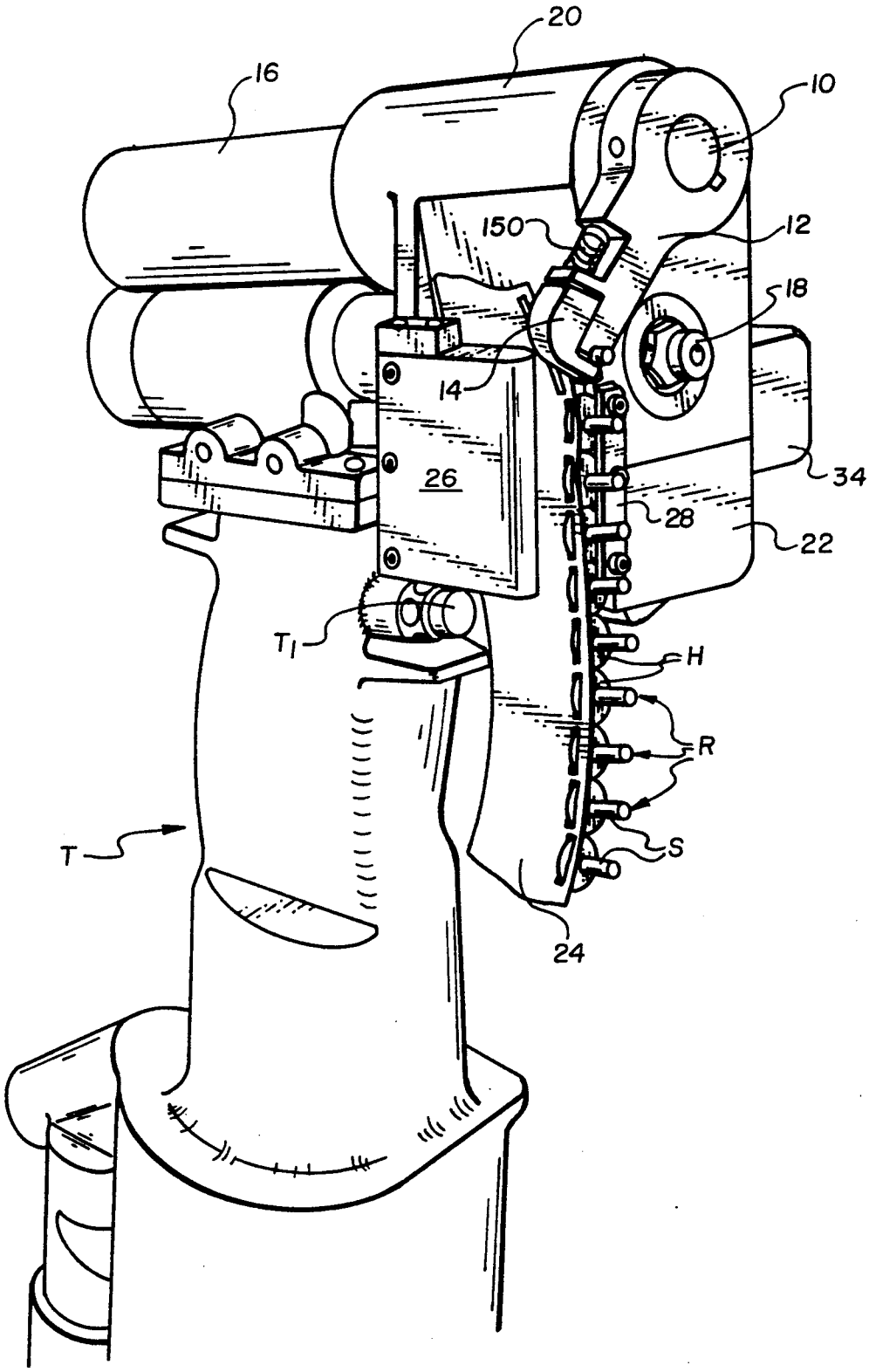
FIG. 1 is a perspective view of a presently preferred embodiment of the present invention in a starting position.

Referring first to FIG. 1, a perspective view of a presently preferred embodiment of the present invention is provided. As discussed earlier, a long felt need has existed in the art to provide an automatic rivet feed apparatus which is reliable, lightweight, portable, and easy to operate and which can be installed on a variety of riveting tools.

Represented in FIG. 1 is a riveting tool T such as is known in the art. For example, the riveting tool preferred for use with the represented embodiment is marketed under the trademark CHERRY®and further information regarding this tool is available from Textron Inc. of Providence, Rhode Island. Other riveting tools can also be readily used with the present invention. The illustrated riveting tool, and riveting tools generally, include a nose piece, generally designated at 8, into which rivets R are inserted. While other riveting tools may be configured differently than the illustrated tool, all include a location where the rivet is held as it is inserted into the work piece and which functions as the nose piece 8 of the illustrated riveting tool. Advantageously, embodiments of the present invention can be adapted as a retrofit on any number of riveting tools, both those configured similarly to the illustrated riveting tool 8 and to those which are configured differently.

The described riveting tool T includes a pneumatic connection (not illustrated in the drawings) which is connected to a standard source of pneumatic pressure. Also, embodiments of the present invention can be connected directed to the power source for the riveting tool or can preferably take its power from the riveting tool.

The rivets R are held in sequential order by a rivet strip 24, whose structure will be explained in greater detail shortly. As will be discussed further later, the rivets are advanced one-by-one to a rivet pick-up point. A rivet track cover 28 holds the rivet heads H in place while a rivet strip backing plate 26 holds the rivet strip 24 in position.

Also represented in FIG. 1 is a pick-up arm 12 which is mounted on a piston !0. A pick up hand 14 is provided at the end of the pick up arm 12. The pick up hand 14 is spring loaded (see spring 150) and fictionally grips the shank S of rivets R while they are individually advanced to the pick-up point and while they are moved to the nose piece 8. Once a rivet R is inserted into the nose piece 8, the pick up hand 14 releases the rivet R.

The piston 10 is part of a pneumatic ram which performs essential rivet movement functions. The ram includes a ram cylinder 16 and ram body 20. The ram body 20 holds the structures in place on the riveting tool T using a set screw (see 156 in FIGS. 8A-8B). The ram structures disclosed herein are pneumatic powered. Those skilled in the art will appreciate that other sources of power, such as an electric or hydraulic motor, can also be used.

Significantly, other available rivet feed schemes generally feed the rivets from a position behind the nose piece of the riveting tool. Thus, such schemes must be integrally incorporated into the design of the tool. In contrast to such previously advanced schemes, the embodiments of the present invention feeds the rivets from in front of the nose piece. Thus, the embodiments of the present invention provide a simpler mechanism which can be retrofitted on a variety of riveting tools.

In FIG. 1, the piston 10, the pick-up arm 12, and the pick-up hand 14 are shown in a starting position. The pick-up hand 14 has gripped a rivet R. Structures are provided, as will be explained later, to allow the rivets R to be removed from the rivet strip 24. The rivet strip 24 is constructed so that the rivets R are securely held therein until released at the rivet pick-up point.

Using the information presented herein, those skilled in the art will readily be able to fabricate embodiments of the present invention which are suitable for use with other configurations of rivets, and particularly blind rivets, as well as different sizes of rivets.

Figure 2:
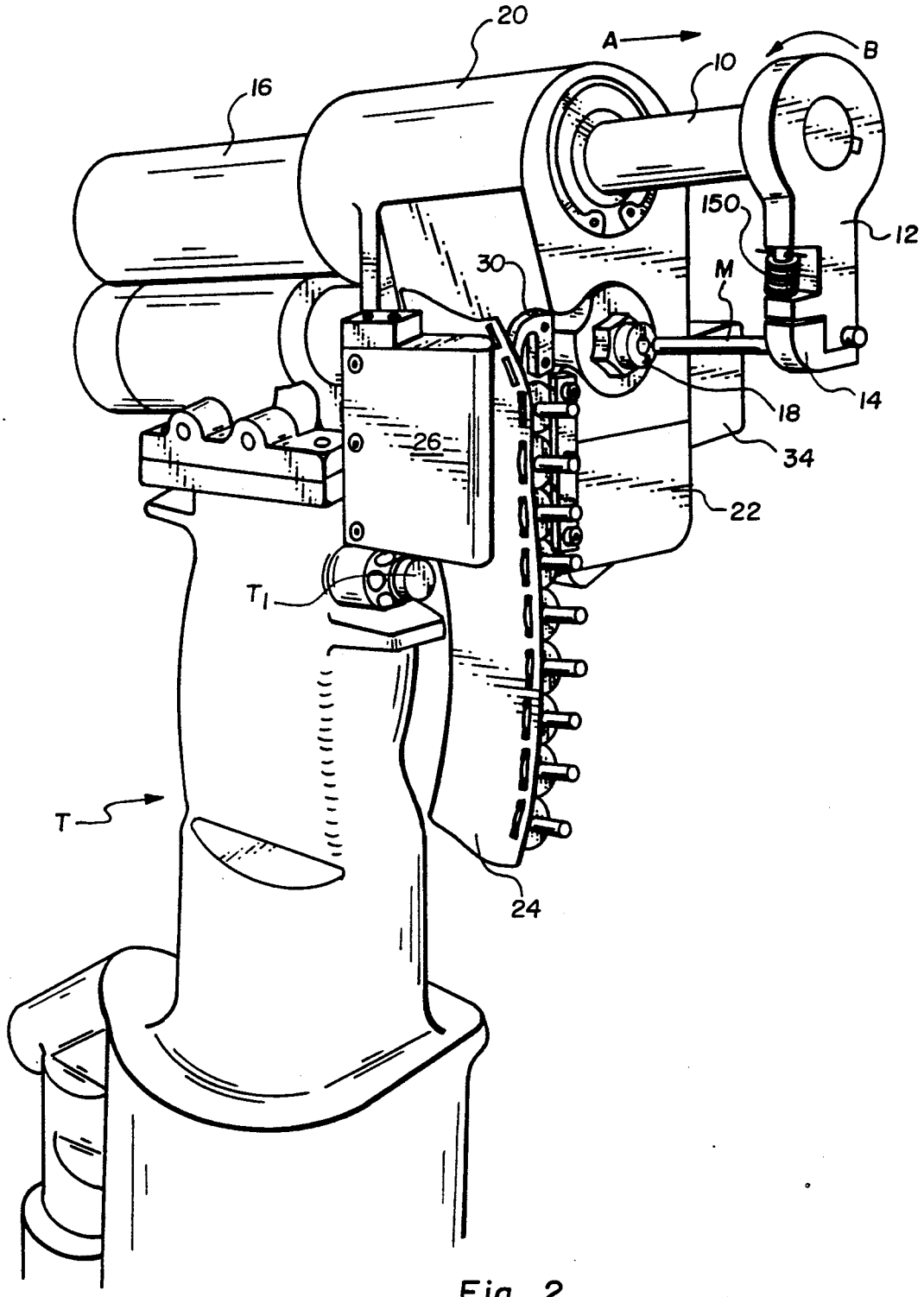
FIG. 2 is a perspective view of the embodiment represented in FIG. 1 in a position ready to insert a rivet into the nose piece of riveting tool.

Referring next to FIG. 2, the piston 10 has extended in the direction indicated by Arrow A and rotated in the direction indicated by Arrow B. The rotation of the piston 10 places the mandrel M of rivet R in alignment with the nose piece 8 ready for insertion therein. The structure of the pneumatic ram, including piston 10, ensures that the pick-up hand 14 will move to precisely the pick-up position and precisely in alignment with the nose piece 8. In the embodiment represented in FIG. 2, the end of an U-shaped channel formed in a rivet strip release hook 30 functions to stop the advance of the rivets R consistently at the rivet pick-up point and to bend the edge of the rivet strip 24 so that the rivets can be removed from the rivet strip 24 as will be explained further in connection with FIGS. 5A-5C.

Figure 3:
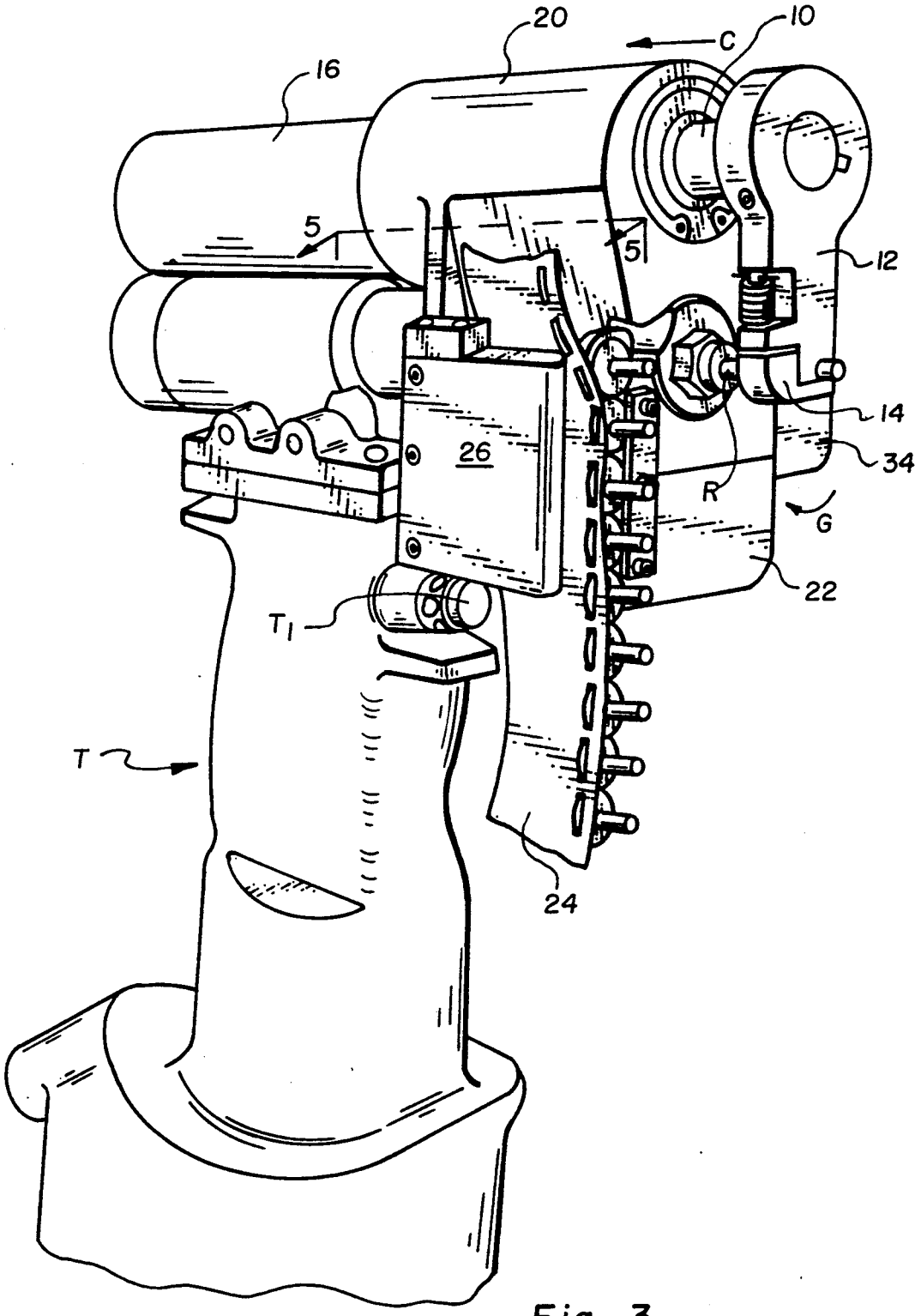
FIG. 3 is a perspective view of the embodiment represented in FIG. 1 in a position where the rivet has been inserted into the nose piece of a riveting tool.

Referring next to FIG. 3, the piston 10 is represented as being retracted into ram cylinder 16 with the rivet R being inserted into the nose piece 8. Once the rivet R has been fully inserted into the nose piece 8, the piston 10 will rotate in the direction indicated by Arrow G, then fully retract to return to the pick-up point and grip another rivet R as illustrated in FIG. 1. With the rivet R inserted into the nose piece 8, an operator (not represented) inserts the rivet R into the work piece (not illustrated) and actuates the tool trigger T setting the rivet in the work.

Figure 4:
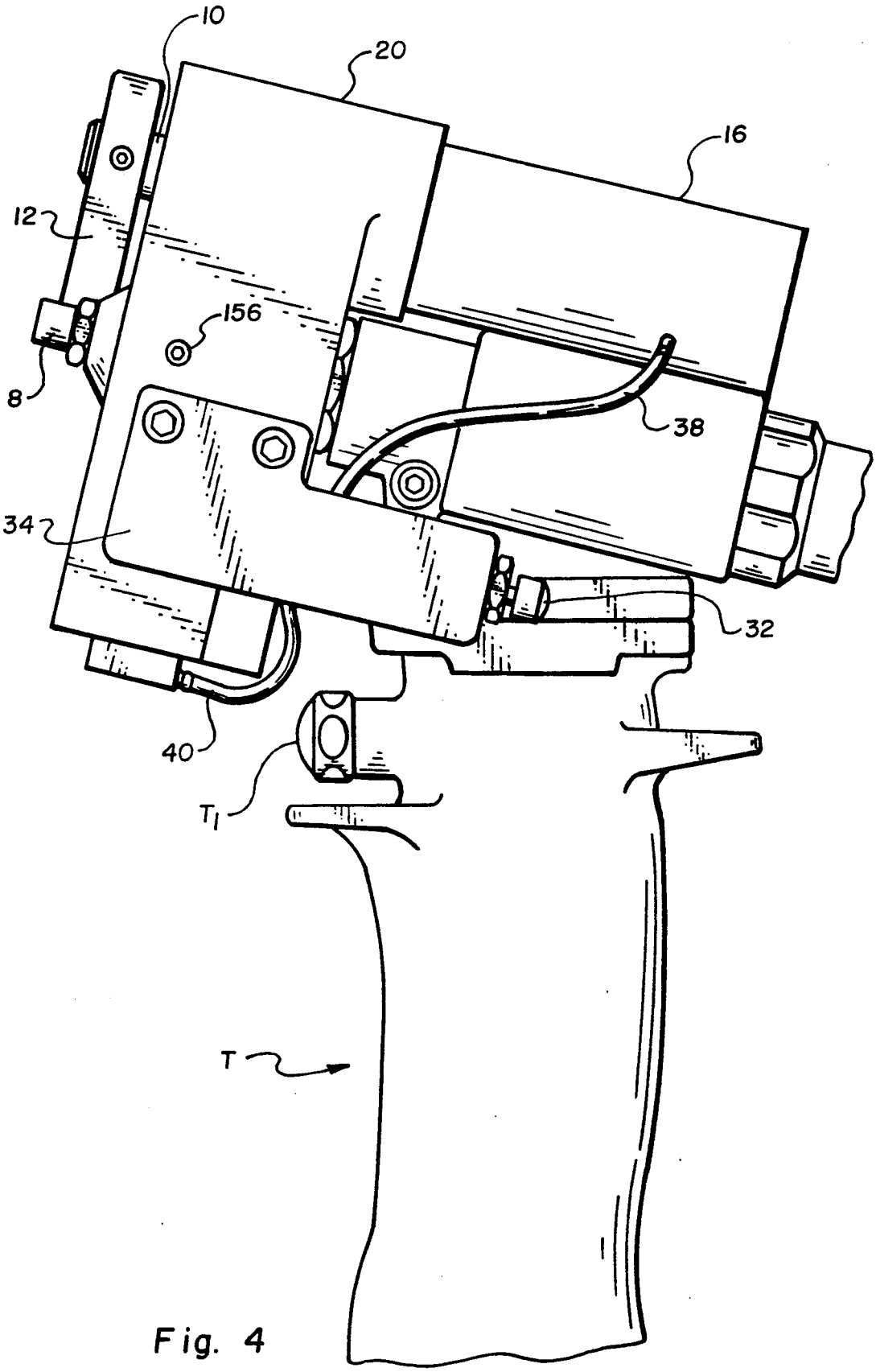
FIG. 4 is a reverse side elevational view of the embodiment represented in FIG. 1.

Reference will be made next to FIG. 4 which is a reverse side elevational view of the embodiment represented in FIG. 1-3. Illustrated in FIG. 4 is a rivet feed trigger 32 and a trigger valve housing 34 which will be described in greater detail using the cross sectional views of FIG. 4A-4E. Pneumatic hoses 38 and 40 convey pneumatic pressure from the trigger valve housing 34 to some of the other structures of the embodiment.

FIGS. 4A-4E are diagrammatic cross-sectional views which will illustrate the operation of the pneumatic circuits included in the represented embodiment. The presence of pneumatic pressure within a circuit or port is indicated by speckles within the illustrated structures. It is to be understood that the illustrated arrangements and structures are merely exemplary and that other structures can be used in the place thereof within the scope of the present invention.

Figure 4A:
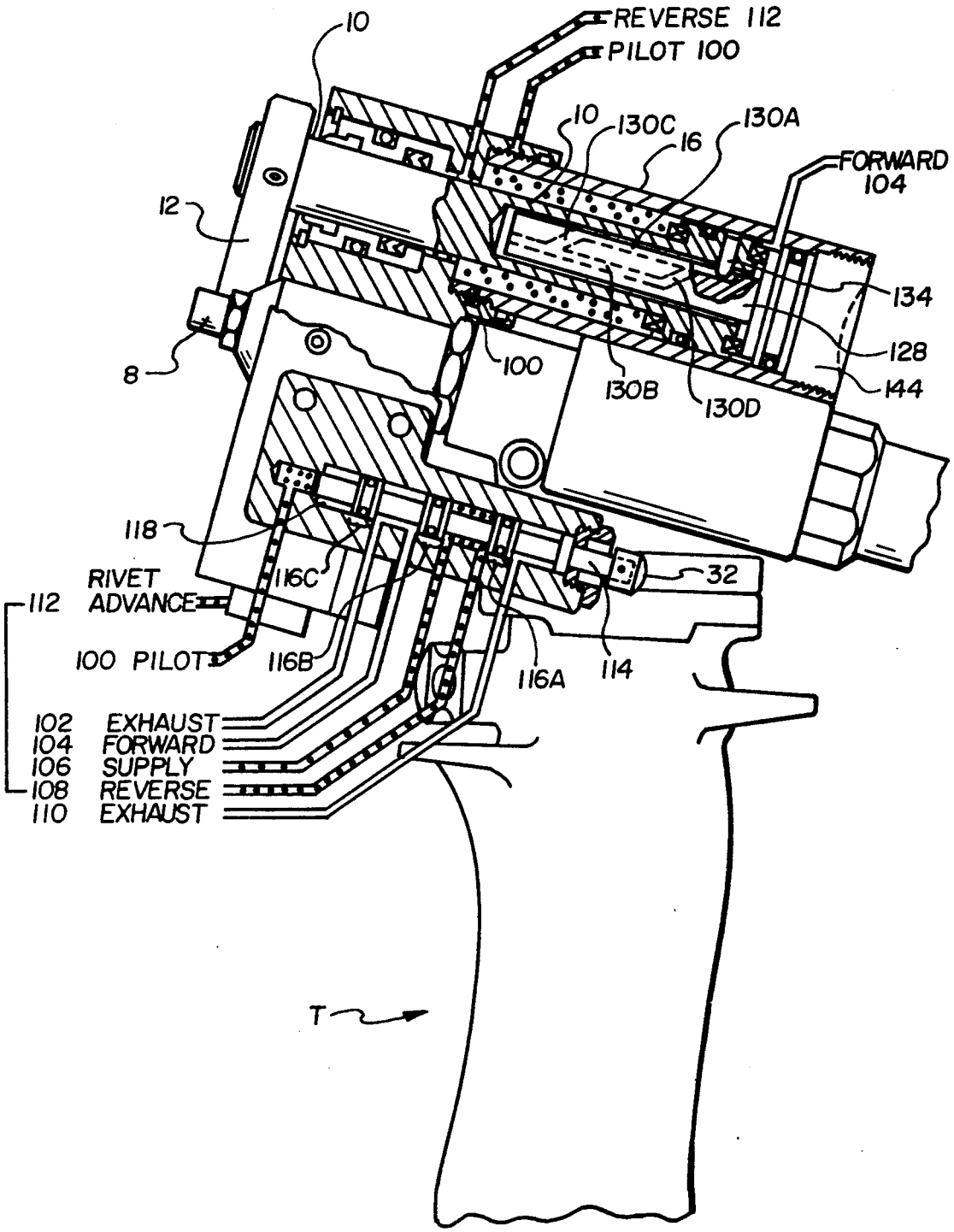
FIG. 4A is a diagrammatic cross-sectional view of the embodiment represented in FIG. 1 showing the pneumatic air circuit when the pneumatic ram is in its starting position.

Starting with FIG. 4A, a plurality of air feed lines are represented in connection with trigger valve housing 34, the ram cylinder 16, and other embodiment structures. While another power source can be used with the present invention, it is preferred that a pneumatic power source be used. Pneumatically powered riveting tools common in the industry, such as the one earlier described, are widely used in commercial and industrial settings. Still, other sources for providing power can be utilized. Preferably, the power requirements for the rivet feed apparatus of the present invention will be compatible with those of the riveting tool.

In the embodiment represented in FIG. 4A, the ports are designated as shown below in Table A.

TABLE A

| Reference Number | Description |
|---|---|
| 100 | Pilot |
| 102 | Exhaust |
| 104 | Forward |
| 106 | Supply |
| 108 | Reverse |
| 110 | Exhaust |

Within the trigger housing 34 is a valve bore 118 to which the above listed lines are connected. A valve spindle 114 is inserted within the valve bore 118 in the trigger valve housing 34. Three gasket assemblies 116A-116C are provided on the valve spindle 114. As the rivet feed trigger 32 is pushed or released by an operator, various pneumatic lines are interconnected to accomplish the embodiment's functions as will be described next.

The embodiment illustrated in FIG. 4A is in its starting position; the piston 10 is fully retracted and the pick-up arm 12 is at the rivet pick-up position where a rivet is gripped. Pneumatic pressure is transferred from within the ram cylinder 16 when pressure is in the reverse line 108. The pressure in the pilot line 100 functions to push the valve spindle 114 to its starting position when the operator releases the trigger. Pneumatic pressure can be supplied by a pump or other source of pneumatic pressure. A supply line 106 is always supplied with pneumatic pressure.

The pressure supplied by the pilot line 100 causes the rivet feed trigger 32 to normally be in the position illustrated in FIG. 4A. The reverse line 108 connects to the valve bore 118 and to the interiors of the ram body 20 and the ram cylinder 16. Thus, the piston lo is fully retracted and kept in that position until the rivet feed trigger 32 is actuated.

Also as represented in FIG. 4A, the rivet advance line 112 is connected to the reverse line 108. Thus, as will be explained later in connection with FIGS. 5A-C, the rivet feed structures operate only when pneumatic pressure is present on the reverse line 108.

Those skilled in the art will appreciate that the timing of the herein described operations are important to the proper working of the embodiment of the present invention. Advantageously, using the structures and the teachings disclosed herein, an embodiment of the invention can be fabricated without using pneumatic logic devices which are known in the art to control the timing of the moving structures. Still, it is within the scope of the present invention to include such pneumatic logic devices to control the timing of movement of the structures of the present invention.

Figure 4B:
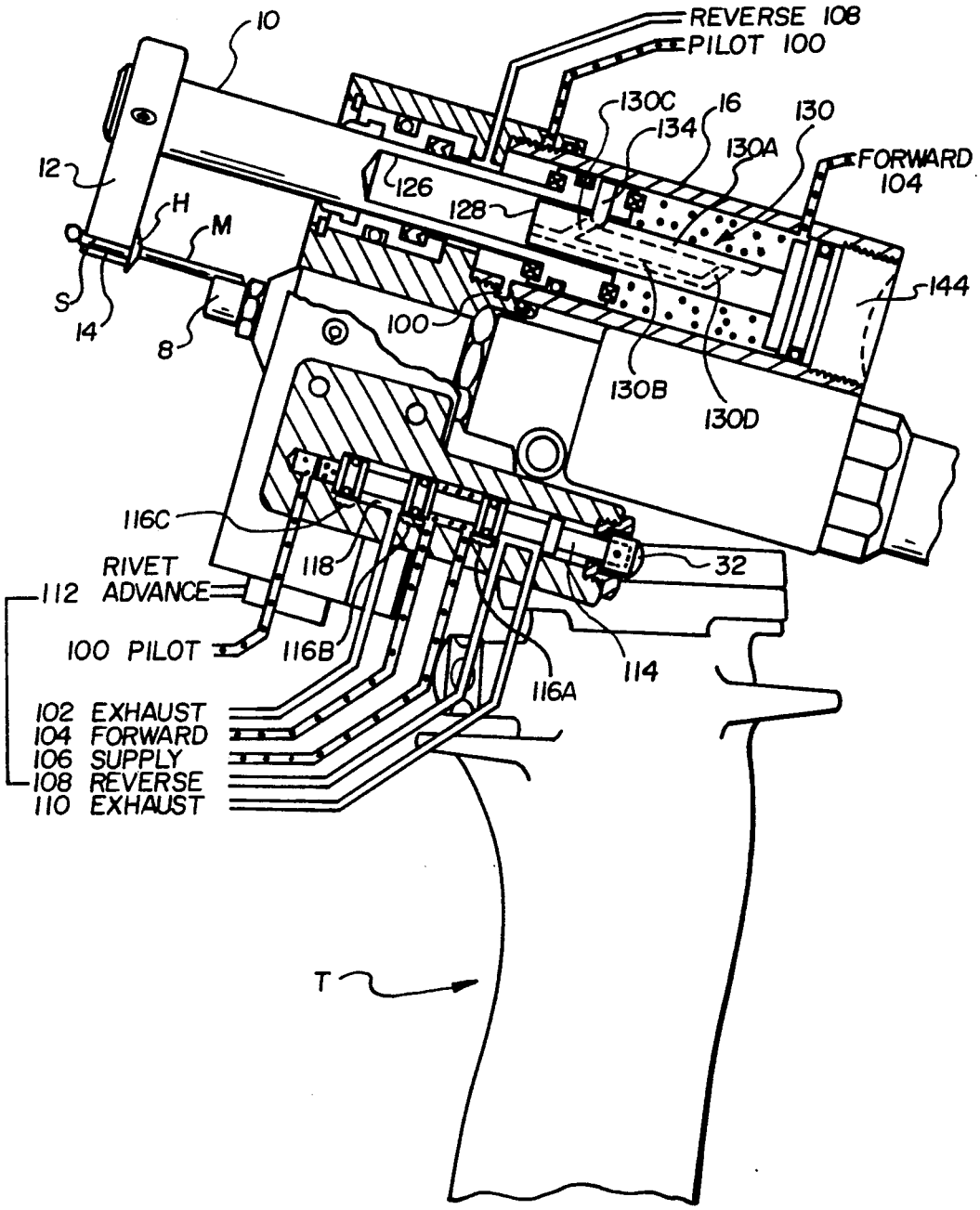
FIG. 4B is a diagrammatic cross-sectional view of the embodiment represented in FIG. 1 showing the pneumatic air circuit when the pneumatic ram is being extended in a forward direction.
Figure 4C:
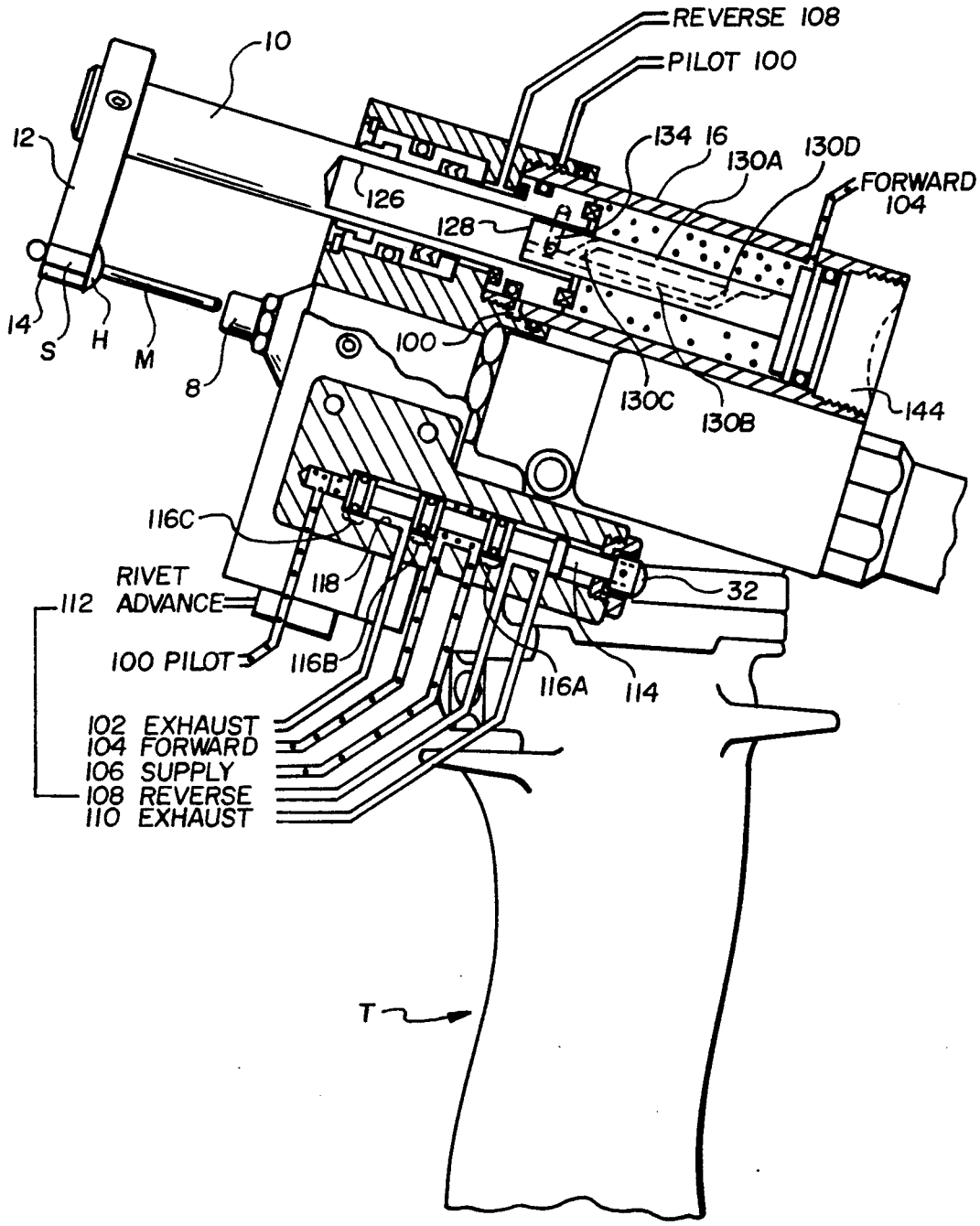
FIG. 4C is a diagrammatic cross-sectional view of the embodiment represented in FIG. 1 showing the pneumatic air circuit when the pneumatic ram is fully forward and the rivet is positioned in alignment with the riveting tool nose piece.

Referring next to FIG. 4B, the rivet feed trigger 32 is represented as having been actuated (depressed) causing the valve spindle 114 and the gasket assemblies 116A-116C to move to a new position, referred to as the "advance ram" position, within valve bore 118. With the valve spindle 114 in the position represented in FIG. 4B, the supply line 106 is connected to forward line 104. The supply pneumatic pressure on the forward line 104 enters the ram cylinder 16 causing the piston 10 to extend out of the ram cylinder 16.

Still referring to FIG. 4B, the piston 10 is represented as having traveled approximately three-quarters of the length of the ram cylinder 16. Until the piston 10 reaches the point represented in FIG. 4B, its movement has been merely linear. In order to place the mandrel M of the rivet R in alignment with the nose piece 8, the piston 10 will begin to rotate as will be explained next. It is the present invention's feature of feeding rivets from the front of the nose piece, in contrast to other rivet feeding apparatus, which requires the ram structure to uniquely provide both linear and rotational movement.

As represented in FIG. 4B, the piston 10 is provided with an inwardly directed guide pin 134. The guide pin 134 engages a track, generally designated at 130, provided on a guide post 128. The track 130 can be either a depression or a raised ridge. The track 130 can also be formed on a stationary structure, such as the guide post 128, or on the movable structure, such as piston 10. The guide post 128 is fixed to a end cap 144 which is in turn threaded into the ram cylinder 16. Thus, the guide post 128 slides into a bore 126 provided within the piston 10 and remains stationary as the piston 10 extends and retracts.

As the piston 10 extends forward to the position represented in FIG. 4B, the piston 10 is kept from rotating by the engagement of guide pin 134 with a forward track 130A. It will be appreciated by those skilled in the art that the configuration of the guide pin 134 and the track 130 must be considered in order to obtain precise and smooth operation of the embodiment.

Once the piston 10 has reached the forward end of the forward track 130A, the guide pin 134 is directed into a forward diagonal track 130C which causes the piston 10 to rotate from the rivet pick-up point alignment where it started in to a nose piece alignment necessary to insert the mandrel M of the rivet into the nose piece 8 of the riveting tool T. As the piston 10 rotates, it continues to extend. Once the guide pin 134 exits the diagonal track 30C, the piston 10 has fully rotated so that the mandrel is fully aligned with the nose piece 8. The guide pin 134 continues to move forward in a reverse track 130B until it reaches the position represented in FIG. 4C.

Figure 4D:
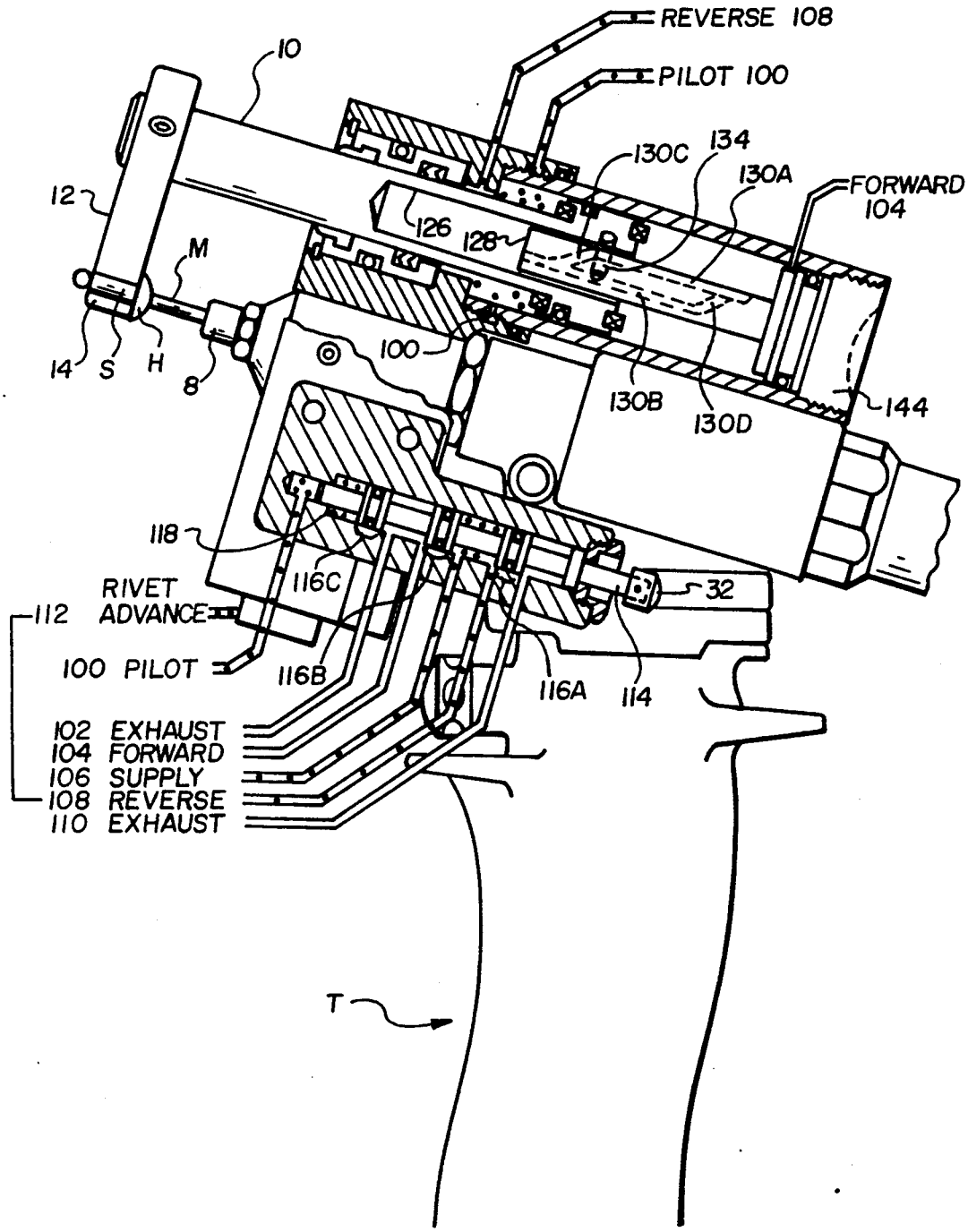
FIG. 4D is a diagrammatic cross-sectional view of the embodiment represented in Figure showing the pneumatic air circuit when the pneumatic ram is moving in a reverse direction to insert the rivet into the nose piece of the riveting tool.

With the mandrel fully aligned with the nose piece 8, the operator releases the rivet feed trigger 32 and the valve spindle 114 returns to the position represented in FIG. 4D. With the valve spindle 114 in the position represented in FIG. 4D, the reverse line 108 and the rivet advance line 112 are again connected to the supply line 106.

Continuing to refer to FIG. 4D, with pneumatic pressure applied to the reverse line 108 air is forced into the ram cylinder 16 pushing the piston 10 back toward its starting position. As the piston 10 is retracted, the guide pin 134 travels down the reverse track 130B until the mandrel M is fully inserted into the nose piece 8. At the point where the mandrel M is fully inserted into the nose piece 8, the guide pin 134 has just reached the reverse diagonal track 130D. As the guide pin 134 enters the reverse diagonal track 130D, it causes the piston 10 to rotate pulling the pick-up hand 14 off from the shank of the rivet R. As the piston 10 continues to rotate, it comes back into alignment with the pick-up point once the guide pin 134 reaches the forward track 130A as represented in FIG. 4E.

Figure 4E:
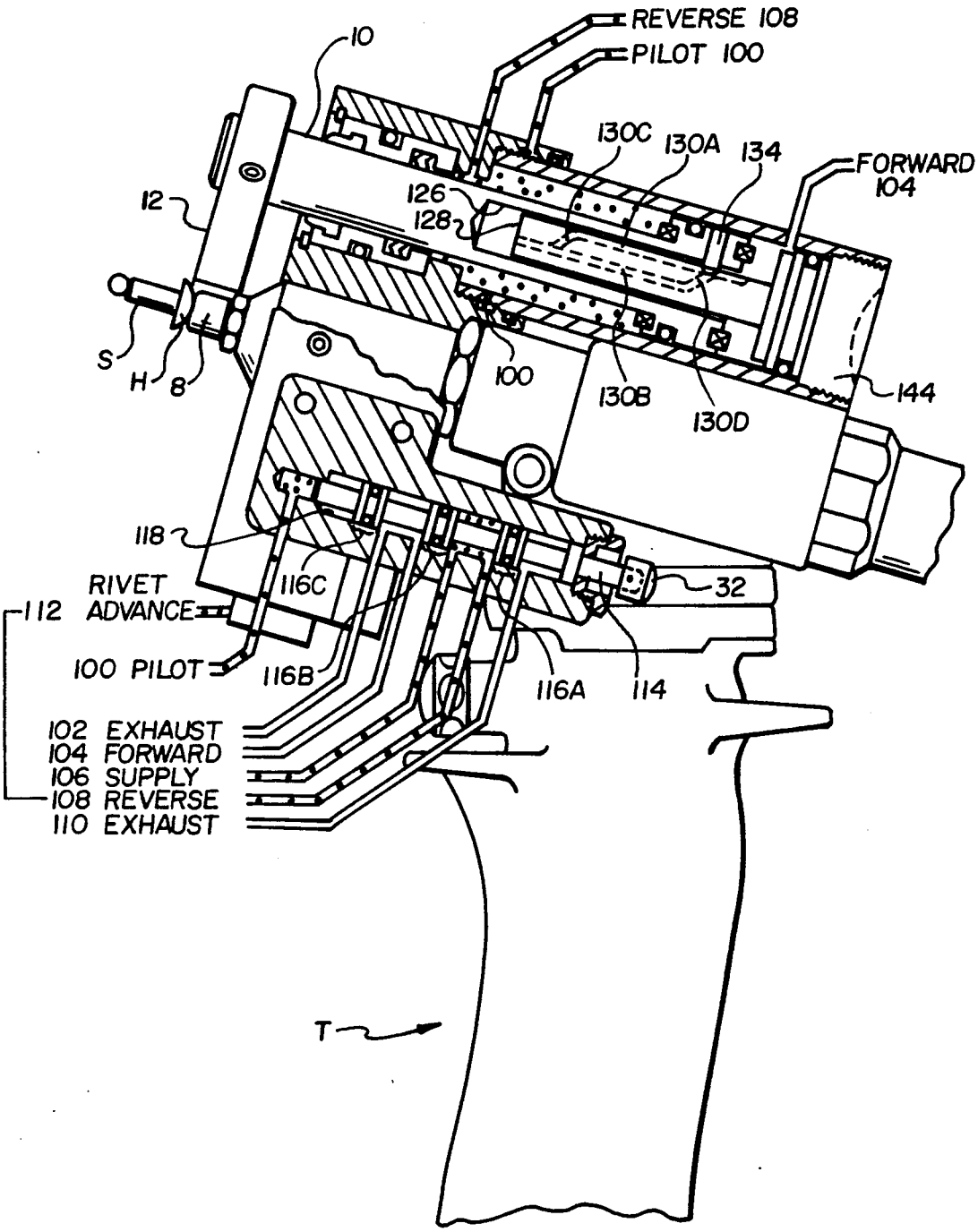
FIG. 4E is a diagrammatic cross-sectional view of the embodiment represented in Figure showing the pneumatic air circuit when the pneumatic ram has fully reversed and retracted to its starting position.

Still referring to FIG. 4E, once the guide pin 134 again reaches the forward track 130A the piston 10 continues to be retracted into the ram cylinder 16. As the piston 10 continues in its reverse movement, the pick-up hand 14 slides onto and engages the shank of another rivet which has been advanced into position at the pick-up point. With the piston 10 fully retracted and the pick-up hand 14 engaging another rivet, the automatic rivet feed operation of the present invention is ready to be carried out again.

While it is presently preferred that the actuation of the rivet feed operation be carried out by an operator manually depressing a trigger, other arrangements can be used to actuate the present invention. For example, those skilled in the art can devise a single two-position trigger incorporated into an embodiment of the present invention to cause the feeding of the rivet and then setting the rivet in the work. It is preferred, however, to use the two trigger (trigger 32 and trigger $T_1$) arrangement which has been described to retrofit an existing riveting tool with an embodiment of the present invention.

The just described ram structure is merely the presently preferred example of a means for moving the rivet from the rivet pick-up point to a nose piece alignment point. Other structures, either known in the art are available in the future, which carry out the same or similar functions are to be considered equivalent to the means for moving the rivet from the rivet pick-up point to a nose piece alignment point of the present invention. Furthermore, the pneumatic circuits just described are the presently preferred example of a means for actuating of the present invention.

Figure 5C:
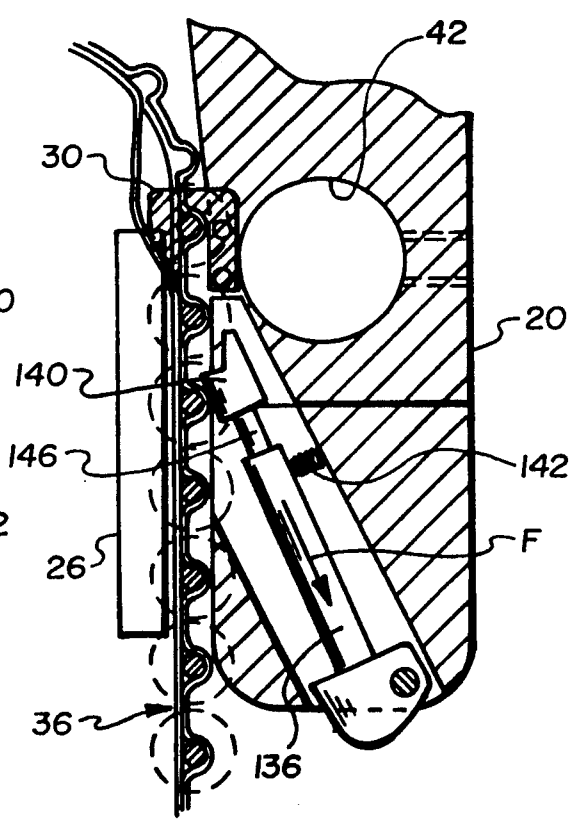
FIG. 5C is a cross sectional view of the embodiment of FIG. 1 taken along line 5—5 of FIG. 3 showing the rivet advance structures of the embodiment in a third position.
Figure 5B:
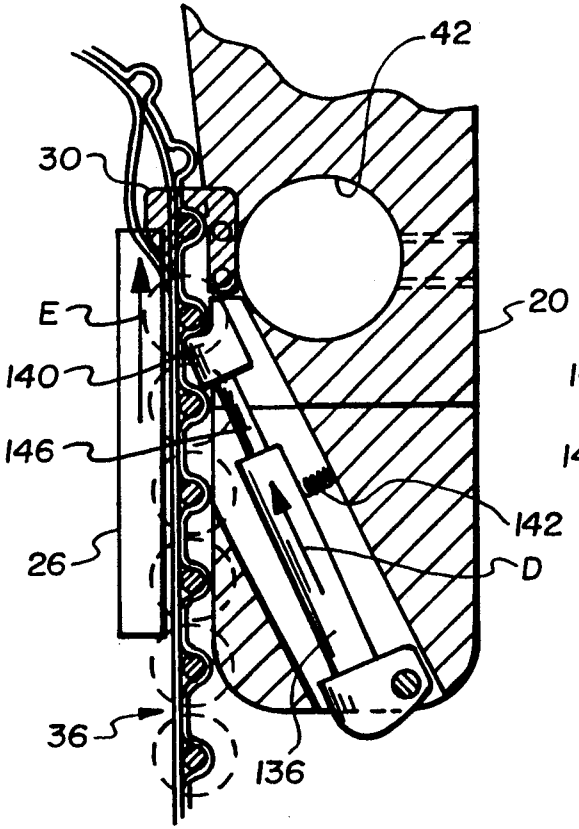
FIG. 5B is a cross sectional view of the embodiment of FIG. 1 taken along line 5—5 of FIG. 3 showing the rivet advance structures of the embodiment in a second position.
Figure 5A:
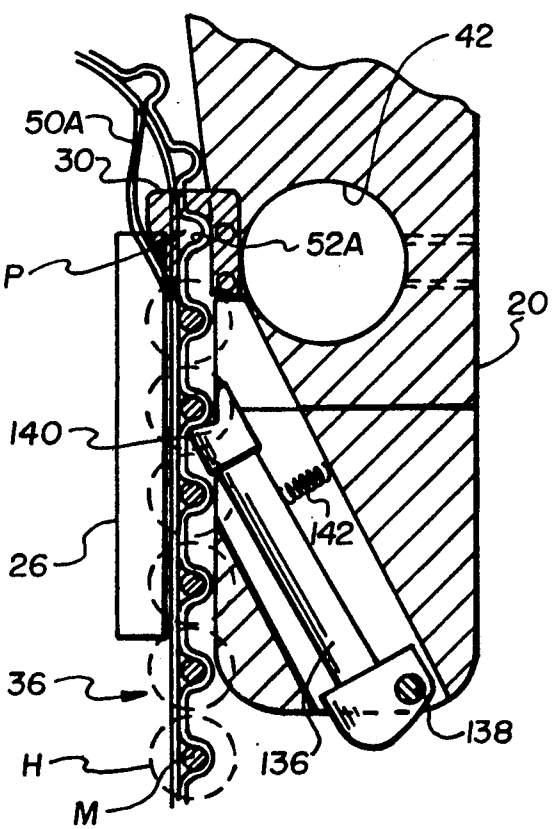
FIG. 5A is a cross sectional view of the embodiment of FIG. 1 taken along line 5—5 of FIG. 3 showing the rivet advance structures of the embodiment in a first position.

Reference will be made next to FIGS. 5A-5C and to FIGS. 6 and 7 to describe the structure and operation of the rivet advance feature of the embodiment. As mentioned, it is an object of the present to increase the speed of the overall riveting operation. In order to increase the rate of setting rivets in a piece of work, the rivets are supplied to the operator in strips. The rivet strips, one example of which is generally indicated at 36 in FIGS.

5A-5C, can hold from 25 to hundreds of rivets. Thus, an operator can set many rivets without needing to stop and attend to rivet loading.

Figure 6:
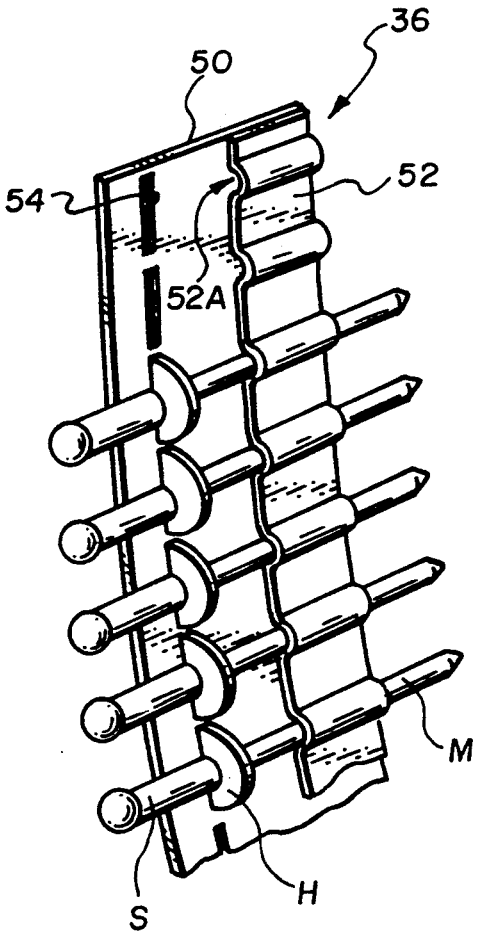
FIG. 6 is a perspective view of one embodiment of the rivet holding strip of the present invention.
Figure 7:
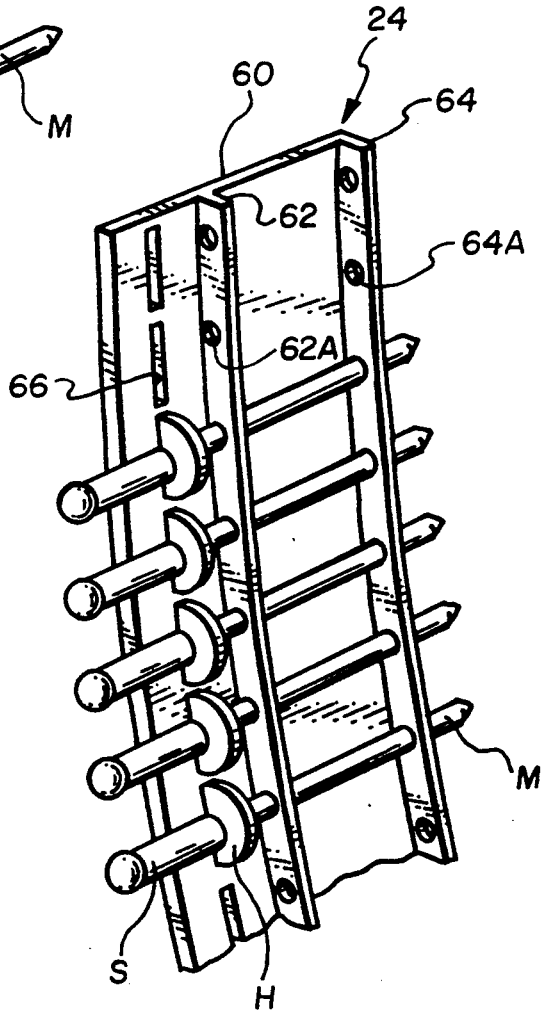
FIG. 7 is a perspective view of one embodiment of the rivet holding strip of the present invention.

One representative embodiment of a rivet strip is illustrated in FIG. 6 and another representative is illustrated in FIG. 7. Illustrated in FIG. 6 is a rivet strip preferably fabricated from paper, a paper-like material, or some other material. The rivet strip represented in FIG. 6 is intended for one time use only.

Illustrated in FIG. 7 is a rivet strip fabricated from a more durable, and if desired a less flexible material, preferably such as a plastic material. If economical, the rivet strip represented in FIG. 7 may be reused. The use of rivet strips allows an operator to set a large number of rivets without stopping to load rivets. For example, a rivet strip can be fabricated which holds only twenty-five rivets or hundreds of rivets.

Referring next to FIGS. 5A-5C, the rivet strip illustrated in FIG. 6 is represented as being moved through the rivet advance structures of the described embodiment. Illustrated in FIGS. 5A-5C the rivet strip backing plate 26 backs rivet strip 36 and holds it in place. A plurality of rivets are shown placed in the rivet strip 36 with their heads H shown in phantom image and their mandrels M shown in cross section.

In FIG. 5A, the rivet pick-up point is represented at P. In FIG. 5A, a rivet has just been moved from the rivet pick-up point P and the empty rivet receptacle 52A remains. The rivet strips used with the present invention must securely hold the rivets until they reach the pick-up point of the apparatus and then must be able to release the rivet. Also represented in FIGS. 5A-C is a hole 42 through which the nose piece 8 protrudes through ram body 20.

In FIG. 5A, the primary structures which function to advance rivets to the pick-up point are three pneumatic rivet advance rams (see FIG. 8A), all operating in parallel, one of which is illustrated at 136. It is preferred that rivet advance rams 136 be those available under the trademark CLIPPARD TM MINIMATIC TM, Model No. SM-3. Other types of devices can also be used within the scope of the present invention. Since the riveting tool and the other components of the presently preferred embodiment of the present invention are pneumatically operated, it is particularly preferred that the rivet advance rams 136 also be pneumatically operated.

Also represented in FIG. 5A is a rest 140 which is affixed to the piston (146 in FIGS. 5B-5C) of the rams 136. The rest 140 is adapted to engage the rivets and advance the rivets to the pick-up point. Also represented in FIG. 5A is an advance ram locating pin 138 which allows the advance rams 136 to pivot and a spring 142 which biases the rest 140 against the rivets and the rivet strip.

In the embodiment represented in FIGS. 5A-5C, rivet strip release hook 30 performs two primary functions. One function is that of stopping the rivets at precisely the pick-up point. The inverted U-shaped channel formed in the rivet strip release hook 30 securely receives the mandrel of each rivet and holds it at the pick-up point against the pressure exerted by the rivet advance rams 136.

The rivet strip release hook 30 also allows the head of the rivets to be removed from the slots formed in the rivet strip 36. As represented best in FIG. 6, the head of each rivet is held captive by a slot 54 formed in the paper substrate 50 of the rivet strip 36. Referring again to FIG. 5A, the rivet strip release hook 30 tears away the slotted portion of the paper substrate, indicted at 50A in FIG. 5A, which allows the rivet to be removed from the rivet strip 36. If a rivet strip is fabricated from a stronger or more rigid material, such as a plastic, the rivet strip release hook 30 functions to bend the substrate so that the rivet heads are no longer held captive by the slots, such as those represented at 66 in the plastic substrate 60 illustrated in FIG. 7. The bending action of the rivet strip release hook 30 can be best observed in FIG. 3.

In FIG. 5A, the rivet advance rams 136 are fully retracted and the rest 140 is supporting a rivet. The timing of the operation to the rams of the embodiment is preferably such that when the pick-up hand 14 is not gripping a rivet at the pick-up point, a rivet held captive in the rivet strip 36 is supported by the rest 140. In this way, the rivet strip 36 is kept from falling out of position.

As explained earlier in connection with FIGS. 4A-4E, the rivet advance line 112 which is connected to the rivet advance rams 136 is coupled to the reverse line 108. Thus, when pneumatic pressure is placed on the reverse line 108 it is also placed on the rivet advance line 112 causing rivet advance rams 136 to extend in the direction of Arrow D as represented in FIG. 5B. The extension of rivet advance rams 136 causes the rivet strip 36 to move in the direction of arrow E and moves another rivet to the pick-up point. The movement of the rest 140 is stopped by its abutment against a rivet advance ram stop 148 (see best in FIGS. 8A and 8B). The spacing of the rivets on the rivet strip 36 and the offset between the rivet advance ram stop 148 and the pick-up point P should be such that the rivet is held snugly against the rivet strip release hook 30.

FIG. 5C illustrates the retraction, in the direction of Arrow F, of the rivet advance rams 136. After the rivet advance rams 136 are fully retracted, the rest 140 assumes the position represented in FIG. 5A supporting another rivet. The rivet advance rams 136 are not retracted until the pick-up hand 14 grips another rivet as illustrated in FIG. 4A.

Using the structures illustrated, an efficient and reliable rivet advance function is carried out. The illustrated structures are merely one example of a means for sequentially advancing a plurality of rivets to a rivet pick-up point. Structures other than those discussed herein can also perform a rivet feed function within the scope of the present invention.

Reference will now be made to FIGS. 6 and 7 for further discussion on the presently preferred embodiments of the rivet strips for use with the present invention.

Illustrated in FIG. 6 is a rivet strip 36 which includes a paper substrate 50, a plurality of slots 54 which receive the heads H of the rivets, and a paper overlay 52 which hold the rivets in position longitudinally on the paper substrate 50. Provided for each rivet is a mandrel receptacle 52A.

Illustrated in FIG. 7 is a rivet strip 24 which includes a plastic substrate 60, a first ridge 62 oriented perpendicularly on the plastic substrate 60, a second ridge 64 oriented perpendicularly on the plastic substrate 60, mandrel receptacles 62A and 64A provided in the first and the second ridges and which receive the mandrels M and hold the rivets in position longitudinally on the plastic substrate 60, and slots 66, or head receptacles, which receive the heads and hold the rivets in position laterally on the plastic substrate 60.

Importantly, the rivet strip must include means for releasibly holding the rivets longitudinally on the rivet strip and means for releasibly holding the rivets laterally on the rivet strip. The receptacles 52A and 62A and 64A are the presently preferred examples of a means for releasibly holding the rivets longitudinally in position on the rivet strips. The slots 54 and 66 are the presently preferred examples of a means for releasibly holding the rivets laterally in position on the rivet strips.

Figure 8A:
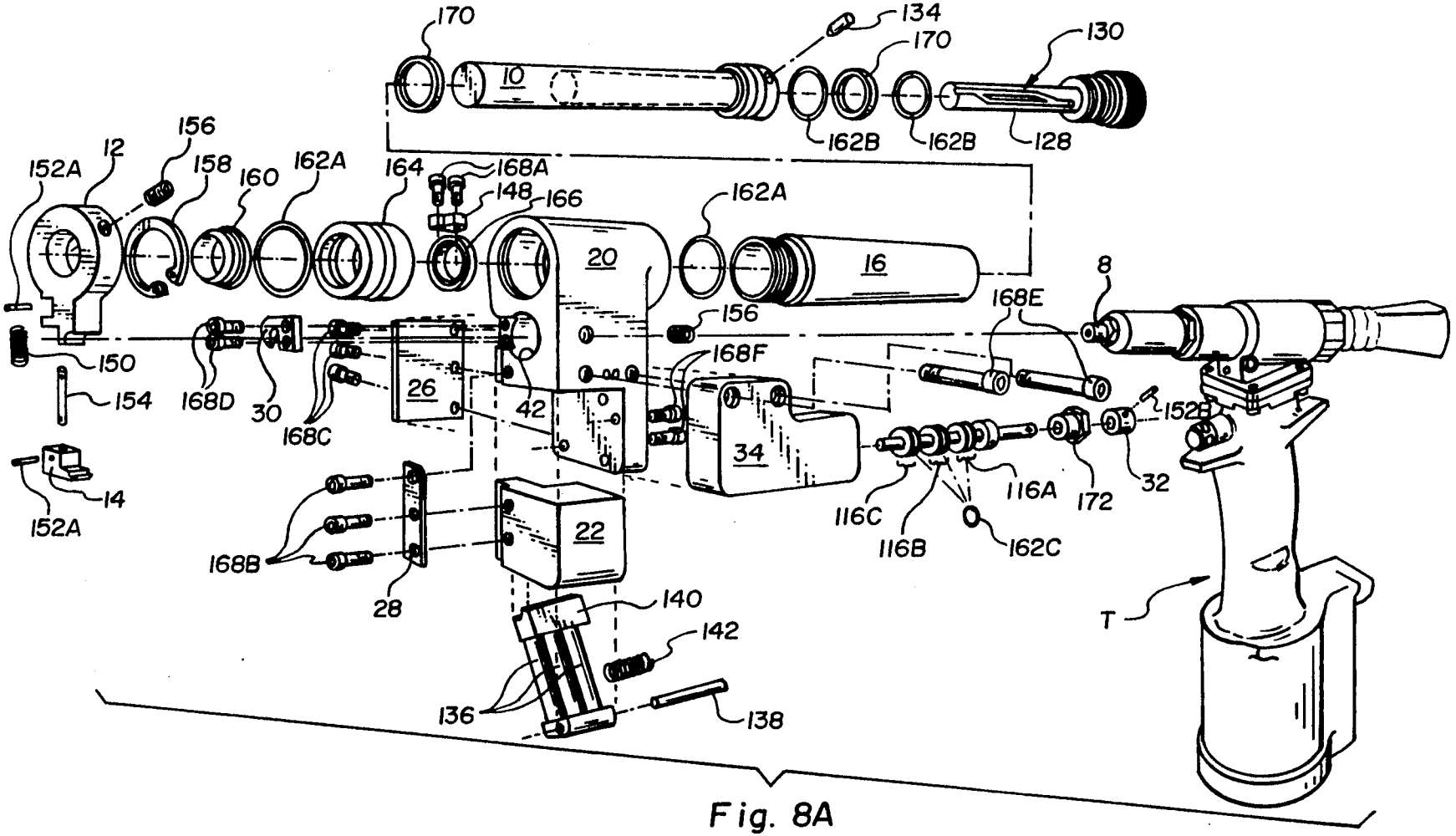
FIG. 8A is an exploded perspective view of the embodiment represented in FIG. 1.
Figure 8B:
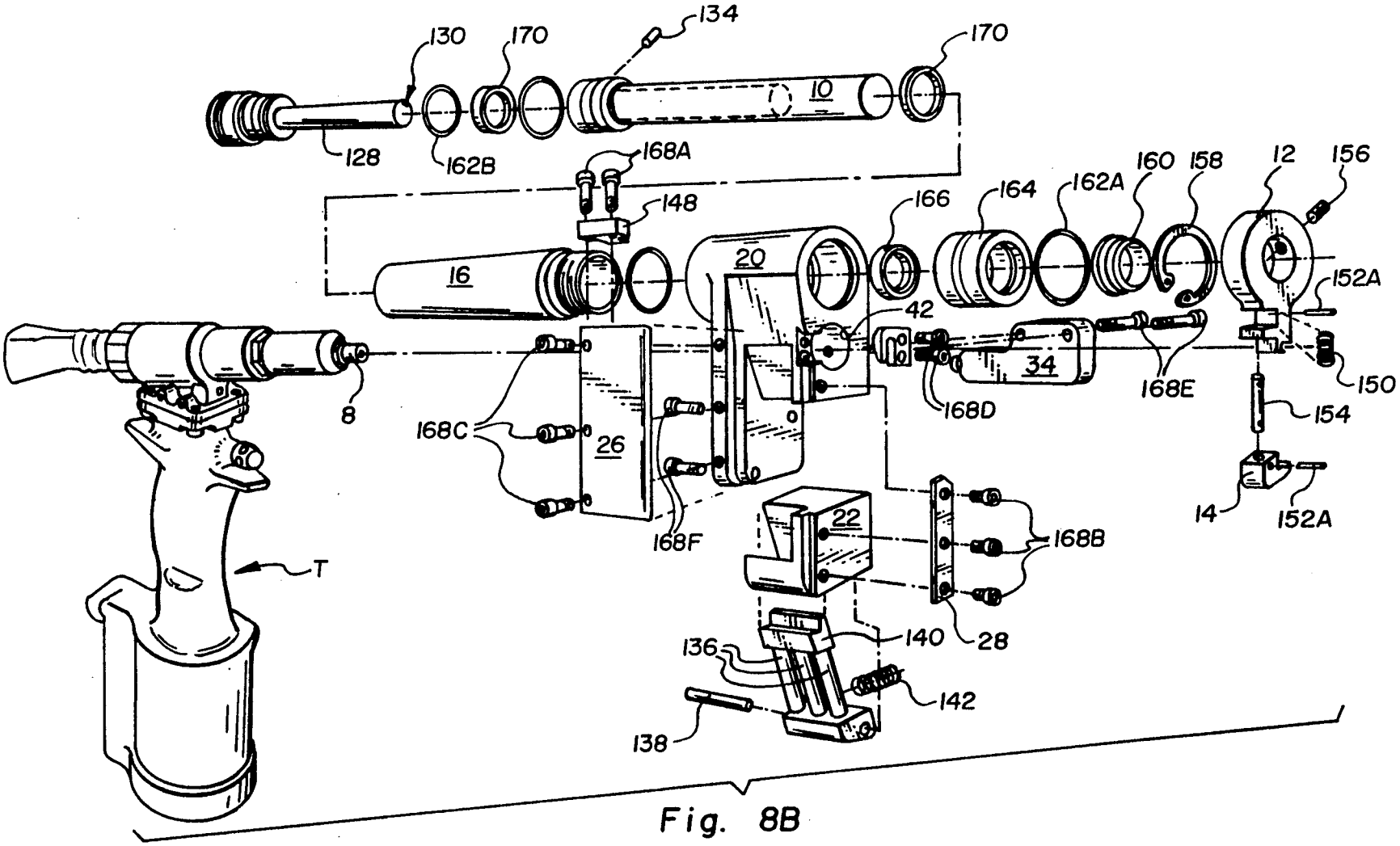
FIG. 8B is a reverse exploded perspective view of the embodiment represented in FIG. 1.

Provided next in FIG. 8A is an exploded perspective view of the embodiment represented in FIGS. 1-3. FIG. 8B provides a reverse exploded perspective view of the embodiment of FIGS. 1-3. In order to provide further details regarding the structures incorporated into the described embodiment, the parts list of Table B, below, is provided referencing the structures illustrated in FIGS. 8A and 8B.

TABLE B

| Reference Number | Description |
|---|---|
| 20 | Ram body |
| 16 | Ram cylinder |
| 10 | Piston |
| 128 | Guide post |
| 34 | Trigger valve housing |
| 22 | Advance ram cover |
| 136 | Rivet advance rams |
| 26 | Rivet strip backing plate |
| 164 | Piston sleeve |
| 12 | Pick-up arm |
| 14 | Pick-up hand |
| 154 | Hand locating pin |
| 152A | Roll pins (3) |
| 152B | |
| 138 | Advance ram locating pin |
| 142 | Springs (2) |
| 150 | |
| 156 | Set screws (2) |
| 158 | Snap ring |
| 160 | Wiper |
| 162A | O-rings (7) |
| 162B | |
| 162C | |
| 166 | Piston seal |
| 170 | Bumpers (2) |
| 134 | Guide pin |
| 148 | Rivet advance ram stop |
| 30 | Rivet strip release hook |
| 114 | Valve spindle |
| 172 | Trigger valve bushing |
| 32 | Rivet feed trigger |
| 28 | Rivet track cover |
| 168A-F | Bolts (14) (sized as needed) |

In view of the forgoing, it will be appreciated that the present invention provides an automatic rivet feed apparatus which operates more efficiently than other available devices and which may be retrofitted onto a variety of existing riveting tools. The present invention also provides an automatic rivet feed apparatus which can be adapted to accept a variety of types and sizes of rivets, which can be implemented at a lower cost than previously available devices, and is compact and lightweight. The present also provides an automatic rivet feed apparatus which increases the overall speed of a riveting operation.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for feeding rivets to the nose piece of a riveting tool, the apparatus comprising:

a linear rivet carrier, the rivet carrier releasably holding a plurality of rivets each in one of a plurality of preselected, substantially uniformly spaced apart locations;

advancing means, when actuated, for sequentially advancing the rivet carrier, each rivet having a corresponding mandrel, so that each rivet is in turn advanced to a rivet pick-up point, the rivet pick-up point being offset from the nose piece;

moving means, when actuated, for frictionally gripping each rivet as it advances to the rivet pick-up point and successively removing each rivet from the rivet carrier and moving each rivet and its corresponding mandrel from the rivet pick-up point to a nose piece alignment point where the mandrel of the rivet is in alignment with the nose piece for insertion of the mandrel into the nose piece, the moving means further for inserting the mandrel of the rivet into the nose piece;

means for actuating the moving means and the advancing means; and means for mounting the moving means and the advancing means on the riveting tool.

2. An apparatus for feeding rivets to the nose piece of a riveting tool as defined in claim 1 wherein the moving means comprises a pneumatic ram including a piston means and a cylinder means, the pneumatic ram comprising means for rotating the piston means as the piston means is extended out of, and retracted into, the cylinder means.

3. An apparatus for feeding rivets to the nose piece of a riveting tool as defined in claim 2 wherein the means for rotating the piston means comprises:

a guide post;

a track disposed on the guide post, the track including a portion which is non-parallel to the length of the guide post;

a guide pin positioned on the piston means, the guide pin engaging the track such that as the piston means is extended out of and retracted into the cylinder means, the action of the track and the guide pin cause the piston means to rotate from the first rotation a position to the second rotational position.

4. An apparatus for feeding rivets to the nose piece of a riveting tool as defined in claim 2 wherein the moving means further comprises a means for shank of the rivet.

5. An apparatus for feeding rivets to the nose piece of a riveting tool as defined in claim 4 wherein the means for gripping the rivet comprises:

an arm;

a hand;

a spring, the spring positioned to bias the hand such that a rivet shank can be inserted and held therein.

6. An apparatus for feeding rivets to the nose piece of a riveting tool as define in claim 1 wherein the means for actuating comprises:

a pneumatic valve; and a trigger, the trigger being depressible by an operator.

7. An apparatus for feeding rivets to the nose piece of a riveting tool as defined in claim 1 wherein the means for mounting comprises:

a body, the body connected to the moving means and the advancing means; and a set screw in the body, the set screw positioned to frictionally engage the riveting tool.

8. An apparatus for feeding rivets to the nose piece of a riveting tool as defined in claim 1 wherein the means for sequentially advancing a plurality of rivets to a rivet pick-up point comprises:

at least one pneumatic ram connected at a first end to the means for mounting;

a rest positioned at the second end of the pneumatic ram, the rest having a shape which can push a rivet to the rivet pick-up point.

9. An apparatus for feeding rivets to the nose piece of a riveting tool as defined in claim 1 wherein the rivet carrier comprises:

substrate means; and means for releasably holding each of the plurality of rivets at individual fixed longitudinal spaced apart positions on the substrate means and to prevent lateral movement of the rivets until the moving means retrieves the rivets.

10. An apparatus for feeding rivets to the nose piece of a riveting tool as defined in claim 1 wherein the rivet carrier comprises:

a substrate having a first elongated longitudinal dimension and a second lateral dimension;

means for releasably holding each of the plurality of rivets at individual fixed longitudinal positions on the substrate; and means for releasably holding each of the plurality of rivets at individual fixed lateral positions on the substrate such that the rivets can be released therefrom at the rivet pick-up point.

11. An apparatus for automatically feeding blind rivets into the nose piece of a riveting tool, the apparatus comprising:

a rivet strip, the rivet strip releasably holding a plurality of rivets;

gripping means for frictionally gripping a rivet at a rivet pick-up point;

means for moving the gripping means from the rivet pick-up point to a nose piece alignment point, the moving means having a first position which is extended to a first linear distance and rotated to a first rotational orientation in relation to the nose piece, the moving means also having a second position which is extended to a second linear distance and rotated to a second rotational orientation relative to the nose piece;

means for sequentially advancing the rivet strip holding a plurality of rivets so that each rivet is moved in turn to the rivet pick-up point to enable the gripping means to grip a rivet when the moving means is in the first position; and means for mounting the moving means and the advancing means on the riveting tool.

12. An apparatus for automatically feeding blind rivets into the nose piece of a riveting tool as defined in claim 11 wherein the gripping means comprises a spring loaded hand.

13. An apparatus for automatically feeding blind rivets into the nose piece of a riveting tool as defined in claim 11 wherein the moving means comprises:

cylinder means;

piston means disposed within the cylinder means;

means for introducing a gas into the cylinder means to cause the piston means to extend out of the cylinder means;

means for introducing a gas into the cylinder means to cause the piston means to retract into the cylinder means; and means for rotating the piston means as the piston is extended out of, and retracted into, the cylinder means.

14. An apparatus for automatically feeding blind rivets into the nose piece of a riveting tool as defined in claim 11 wherein the advancing means comprises:

at least one pneumatic ram connected at a first end to the mounting means:

a rest positioned at the second end of the pneumatic ram, the rest having a shape which can push a rivet to the rivet pick-up point;

a rivet strip comprising:

substrate means; and means for releasibly holding each of the plurality of rivets at individual fixed longitudinal spaced apart positions on the substrate means and to prevent lateral movement of the rivets until the automatic rivet feed system can release and retrieve the rivets.

15. An apparatus for automatically feeding blind rivets into the nose piece of a riveting tool as defined in claim 11 further comprising a means for actuating, the means for actuating comprising:

a pneumatic valve; and a trigger, the trigger being depressible by an operator.

* * * * *

UNITED STATES PATENT AND TRADEMARK OFFICE

CERTIFICATE OF CORRECTION

PATENT NO. : 5,123,162

DATED : June 23, 1992

INVENTOR(S) : Harold R. Wing et al

It is certified that error appears in the above-indentified patent and that said Letters Patent is hereby corrected as shown below:

Col. 4, line 2, after "Figure" insert --1--.
Col. 4, line 7, after "Figure" insert --1--.
Col. 6, line 2, delete "T" and substitute therefor --$T_1$--.
Col. 7, line 1, delete "lo" and substitute therefor --10--.
Col. 8, line 1, delete "30C" and substitute therefor --130C--.
Col. 12, line 58, Claim 4, after "for" insert --gripping the--.

Signed and Sealed this

Third Day of January, 1995

Bruce Lehman

*Attest:*

BRUCE LEHMAN

*Attesting Officer*

*Commissioner of Patents and Trademarks*